US007439934B2

(12) United States Patent
Leisten et al.

(10) Patent No.: US 7,439,934 B2
(45) Date of Patent: Oct. 21, 2008

(54) ANTENNA AND AN ANTENNA FEED STRUCTURE

(75) Inventors: Oliver Paul Leisten, Northampton (GB); Andrew Robert Christie, Northampton (GB); Thomas Alan Clupper, Landenberg, PA (US); John J Squires, Elkton, MD (US)

(73) Assignee: Sarantel Limited, Park Farm South (GB)

( * ) Notice: Subject to any disclaimer, the term of this patent is extended or adjusted under 35 U.S.C. 154(b) by 0 days.

(21) Appl. No.: 11/472,587

(22) Filed: Jun. 21, 2006

(65) Prior Publication Data

US 2007/0063919 A1 Mar. 22, 2007

(30) Foreign Application Priority Data

Jun. 21, 2005 (GB) ..... 0512652.9

(51) Int. Cl.
*H01Q 1/36* (2006.01)

(52) U.S. Cl. ..... 343/895; 343/859; 343/860

(58) Field of Classification Search ..... 343/895, 343/905, 859, 860
See application file for complete search history.

(56) References Cited

U.S. PATENT DOCUMENTS

| | | | | |
|---|---|---|---|---|
| 3,599,220 | A | 8/1971 | Dempsey | |
| 4,608,574 | A | 8/1986 | Webster et al. | |
| 5,635,945 | A | 6/1997 | McConnell et al. | |
| 5,859,621 | A | 1/1999 | Leisten | |
| 5,945,963 | A | 8/1999 | Leisten | |
| 5,963,180 | A | 10/1999 | Leisten | |
| 6,011,524 | A | 1/2000 | Jervis | |
| 6,094,178 | A * | 7/2000 | Sanford | 343/895 |
| 6,133,891 | A | 10/2000 | Josypenko | |
| 6,229,488 | B1 | 5/2001 | Lin et al. | |
| 6,229,498 | B1 | 5/2001 | Matsuyoshi et al. | |
| 6,300,917 | B1 | 10/2001 | Leisten | |
| 6,369,776 | B1 | 4/2002 | Leisten | |
| 6,552,693 | B1 * | 4/2003 | Leisten | 343/895 |
| 6,690,336 | B1 | 2/2004 | Leisten | |
| 6,886,237 | B2 | 5/2005 | Leisten et al. | |
| 7,002,530 | B1 | 2/2006 | Chung et al. | |
| 7,256,752 | B2 * | 8/2007 | Wither et al. | 343/905 |
| 2005/0115056 | A1 | 6/2005 | Leisten et al. | |
| 2006/0022892 | A1 | 2/2006 | O'Neill, Jr. et al. | |
| 2006/0038739 | A1 | 2/2006 | Feng et al. | |

FOREIGN PATENT DOCUMENTS

| | | | |
|---|---|---|---|
| EP | 0469741 | A | 2/1992 |
| EP | 1076378 | A | 2/2001 |
| GB | 2292257 | A | 2/1996 |
| GB | 2292638 | A | 2/1996 |
| GB | 2297257 | A | 7/1996 |
| GB | 2309592 | A | 7/1997 |
| GB | 2310543 | A | 8/1997 |

(Continued)

*Primary Examiner*—Hoang V Nguyen
(74) *Attorney, Agent, or Firm*—John Bruckner PC

(57) ABSTRACT

A dielectrically-loaded helical antenna has a cylindrical ceramic core bearing metallised helical antenna elements which are coupled to a coaxial feeder structure passing axially through the core. Secured to the end face of the core is an impedance matching section in the form of a laminate board. The matching section embodies a shunt capacitance and a series inductance.

39 Claims, 13 Drawing Sheets

FOREIGN PATENT DOCUMENTS

| | | | |
|---|---|---|---|
| GB | 2338605 | A | 12/1999 |
| GB | 2346014 | A | 7/2000 |
| GB | 2351850 | A | 1/2001 |
| GB | 2367429 | A | 4/2002 |
| WO | WO00/48268 | | 8/2000 |

* cited by examiner

ANTENNA AND AN ANTENNA FEED STRUCTURE

CROSS-REFERENCES TO RELATED APPLICATIONS

This application is related to, and claims a benefit of priority under one or more of 35 U.S.C. 119(a)-119(d) from copending foreign patent application 0512652.9, filed in the United Kingdom on Jun. 21, 2005 and from copending foreign patent application 0610823.7, filed in the United Kingdom on Jun. 1, 2006 under the Paris Convention, the entire contents of both of which are hereby expressly incorporated herein by reference for all purposes.

FIELD OF THE INVENTION

This invention relates to a dielectrically-loaded antenna, to a feed structure for such an antenna and to a method of producing a dielectrically-loaded antenna. The invention particularly relates to a 3-dimensional, dielectrically loaded-antenna with metallised conductor elements disposed about a dielectric core having a relative dielectric constant greater than 5; such that the metallised conductor elements define an interior volume that is occupied by that dielectric core; wherein all surfaces of the dielectric core have metallised conductor elements, and the antenna is fed by a feeder structure which passes through the dielectric core, and wherein the frequency of operation of the antenna is in excess of 200 MHz.

BACKGROUND OF THE INVENTION

British Patent Applications Nos. 2292638A and 2310543A disclose dielectrically-loaded antennas for operation at frequencies in excess of 200 MHz. Each antenna has two pairs of diametrically opposed helical antenna elements which are plated on a substantially cylindrical electrically insulative core made of a material having a relative dielectric constant greater than 5. The material of the core occupies the major part of the volume defined by the core outer surface. Extending through the core from one end face to an opposite end face is an axial bore containing a coaxial feed structure comprising an inner conductor surrounded by a shielded conductor. At one end of the core the feed structure conductors are connected to respective antenna elements which have associated connection portions adjacent the end of the bore. At the other end of the bore, the shield conductor is connected to a conductor which links the antenna elements and, in these examples, is in the form of a conductive sleeve encircling part of the core to form a balun. Each of the antenna elements terminates on a rim of the sleeve and each follows a respective helical path from its connection to the feed structure.

British Patent Application No. 2367429A discloses such an antenna in which the shield conductor is spaced from the wall of the bore, preferably by a tube of plastics material having a relative dielectric constant which is less than half of the relative dielectric constant of the solid material of the core.

Dielectrically-loaded loop antennas having a similar feed structure and balun arrangement are disclosed in GB2309592A, GB2338605A, GB2351850A and GB2346014A. Each of these antennas has the common characteristic of metallised conductor elements which are disposed about the core and which are top-fed from a feed structure passing through the core. The conductor elements define an interior volume occupied by the core and all surfaces of the core have metallised conductor elements. The balun provides common-mode isolation of the antenna elements from apparatus connected to the feeder structure, making the antenna especially suitable for small handheld devices.

Hitherto, the feed structure has been formed in the antenna as follows. Firstly, a flanged connection bush, plated on its outer surface, is fitted to the core by being placed in the end of the bore where the feed connection is to be made. Then, an elongate tubular spacer is inserted into the bore from the other, bottom, end. Next, a coaxial line of predetermined characteristic impedance is trimmed to length and an exposed part of the inner conductor at one end is bent over into a U-shape. The formed section of coaxial cable is inserted into the bore and the elongate tubular spacer from above and the entire top connection is soldered in two soldering steps: (a) soldering of the inner conductor bent portion to connection portions of the antenna elements on the top face of the core, and (b) soldering of the flanged bush to the shield conductor and to further antenna element connection portions on the top face of the core. The core is then inverted and a second plated bush is fitted over the outer shield conductor of the cable where it is exposed at the opposite end of the core from the bent section of the inner conductor so as to abut the plated bottom end face of the core. Finally, this second bush is soldered to the outer shield conductor and to the plated bottom end face of the core.

One of the objectives in the design of the antennas disclosed in the prior applications is to achieve as near as possible a balanced source or load for the antenna elements. Although the balun sleeve generally serves to achieve such balance, some reactive imbalance may occur owing to constraints on the characteristic impedance of the coaxial feeder structure and on its length. Additional contributing factors are the difference in length between the inner and outer conductors of the feed structure, e.g., as a result of the bent-over part of the inner conductor, and the inherent asymmetry of a coaxial feed. Where necessary, a compensating reactive matching network in the form of a shorted stub has been connected to the inner conductor adjacent the bottom end face of the core, either as part of the device to which the antenna is connected or as a small shielded printed circuit board assembly attached to the bottom end face of the core.

It is an object of the present invention to reduce the cost of assembling antennas such as those disclosed in the prior applications.

SUMMARY OF THE INVENTION

According to one aspect, the invention provides an antenna with a frequency of operation in excess of 200 MHz with a novel feed structure. The antenna is three-dimensional, having an antenna element structure having a plurality of conductive antenna elements disposed on or adjacent the outer surface of a dielectric core. The relative dielectric constant of the core is greater than 5. Generally, the antenna element structure comprises metallised elements disposed about the core and defines an interior volume at least the major part of which is occupied by the solid dielectric material of the core, the core thereby dielectrically loading the antenna element structure.

The antenna elements extend from feed connections at one end of a feed structure which passes longitudinally through the core on an axis of the antenna. The other ends of the antenna elements may be connected together by a common conductor such as a sleeve which acts as a balun and is connected to the feed structure at a location spaced from the core. For instance, the sleeve can act in combination with a shield conductor of the feed structure to provide a balanced source or load for the antenna elements at the feed connections, the antenna as a whole presenting a single-ended 50 ohm termination for equipment to which it is to be connected. In such a structure, all surfaces of the core have metallised conductor elements.

Matching of the antenna to the equipment may be performed by components within the core or located externally of the core at one end of the passage through the core. Such components may be embodied at least partly in a printed circuit board. This board may be located at one end of a coaxial transmission line housed in the passage through the core, so as to form the connection between the antenna elements linking the antenna elements to the coaxial line. The board may extend laterally from the axis of the coaxial line, and have laterally extending connection members which connect to the antenna elements on when the board is assembled to the core, for instance, to conductors on a distal face of the core. By arranging for the board to lie in a plane perpendicular to the antenna axis, it can lie against the core distal face, conductive layer portions on the underside of the board making face-to-face contact with tracks printed on the core. Conductive layer portions on the outer face of the board may provide connection areas for one or more discrete components (e.g. a capacitor and/or an inductor) forming part of the matching network, or such layer portions may, by themselves or in combination with conductive layers on the underside of the board, constitute components of the matching network.

This feed structure comprises, therefore, the combination of a length of coaxial transmission line and a laminate board extending laterally of the axis defined by the coaxial line. The inner conductor of the line may be located in a through-hole in the board to connect to a track on one face of the board, while the shield connects to the underside of the board or directly to a conductor on the upper face of the distal face of the core. The characteristic impedance of the transmission line is typically 50 ohms.

Depending on the length and characteristic impedance of the coaxial line, the matching network may include reactance compensation by including a reactive impedance transformation. In particular, the matching network may include a capacitance and/or an inductance embodied as conductive tracks on the board or as a discrete component or components attached to tracks on the board.

In the disclosed antenna, the matching network comprises a shunt capacitance, embodied as conductive layer portions in registry with each other on opposite sides of the board. Also disclosed is a version in which the capacitor comprises mutually insulated and adjacent conductive layer portions on one surface of the board, e.g., an interdigital or interdigitated capacitor. In particular, the capacitor may be coupled between a track associated with a signal line from the inner conductor of the coaxial line to a track associated with the shield conductor, using one or more through-hole vias or plated edge connections formed on an edge of the board.

An inductance may be incorporated, e.g., as a series element in the form of a length of conductive track on the board between a connection to the inner conductor of the coaxial line and a conductor on the upper face of the distal face of the core. In this way, the matching network can effect a transformation from the source or load impedance represented by the antenna, which is typically less than 5 ohms and may be as low as 2 ohms, to the load or source impedance presented at the distal end of the coaxial line when the antenna is connected to radio frequency equipment with which it is to be used, typically having a 50 ohm termination.

The combination of the laminate board and the coaxial line may constitute a unitary feed structure which, during manufacture of the antenna, is slidably inserted as a unit into the passage through the antenna core, the feed structure being inserted from the distal face of the core. Abutment of the board and the distal face of the core may be used to locate the feed structure in the axial direction. Solder paste is screen-printed to form a connection between the board and the core and, around the coaxial line where it is exposed at the proximal face of the core a solder preform is used, to allow a one-shot reflow soldering of the feed structure components to metallised conductor elements on all surfaces of the core.

Mechanical connection between the laminate board and the coaxial line may be made by way of one or more longitudinally extending lugs on the shield conductor of the coaxial line located in correspondingly formed recesses or holes in the board where the lugs may be soldered to conductive layer portions on the board. The lugs may be an interference fit in the holes or recesses, or they may be bent over to lock the board to the shield. As an alternative, the distal end of the shield may be swaged outwardly to locate against a distally facing surface on the core adjacent the distal end of the passage and to provide for abutting electrical connection to a conductive layer portion on the proximal surface of the board.

According to a particular aspect of the invention, there is provided a dielectrically-loaded antenna for operation at a frequency in excess of 200 MHz comprising: an electrically insulative core of a solid material having a relative dielectric constant greater than 5 and having transversely extending end surfaces and a side surface which extends longitudinally between the end surfaces; a three-dimensional antenna element structure including at least a pair of elongate conductive antenna elements disposed on or adjacent the side surface of the core and extending from one of the end surfaces towards the other end surface; a feed connection comprising first and second feed connection conductors coupled respectively to one and the other of the said pair of antenna elements; and a matching section including a shunt capacitance coupled across the antenna elements of the pair.

In the preferred antenna, the core is cylindrical and the antenna elements of the said pair comprise conductive helical tracks each extending from the said one end surface over the cylindrical side surface, and the antenna element structure includes a linking conductor encircling the core and interconnecting ends of the said antenna elements which are at locations spaced from the above-mentioned one end surface of the core. The feed connection and the matching section may comprise part of a feeder structure which also includes a transmission line section terminating in the feed connection. Whilst the preferred antenna has a transmission line section characteristic impedance of 50 ohms, in general, the characteristic impedance is selected according to the equipment for which the antenna is intended.

According to another aspect of the invention, there is provided a backfire dielectrically-loaded antenna for operation at a frequency in excess of 200 MHz comprising: a cylindrical electrically insulative core of the solid material having a dielectric constant greater than 5 and having axially directed proximal and distal surfaces and a cylindrical side surface; a three-dimensional antenna element structure including at least one pair of elongate conductive antenna elements disposed on or adjacent the side surface of the core and each extending from the distal surface of the core in the direction of the proximal surface; and a feed structure comprising the combination of a transmission line section having at an end thereof a first conductor coupled to one of the said pair of antenna elements and a second conductor coupled to the other of the said pair of antenna elements and, associated with the said end of the transmission line section, a matching section in the form of a laminate board including at least one reactive matching element.

In the case of the laminate board including at least one reactive matching element, this element may be formed by at least one conductive layer of the board. Alternatively, the element may be formed as a lumped reactive matching component mounted on conductive areas of the board.

The reactive element may be a shunt reactance connected across the antenna elements of the above-mentioned pair of antenna elements. In addition, the matching section may also include a second reactive element comprising the reactance connected in series between the shunt reactance and either one of the antenna elements or the respective conductor of the transmission line section.

The preferred antenna is a quadrifilar helical antenna having four longitudinally coextensive half-turn helical antenna elements which, at the distal end of the core, have distal ends spaced around the periphery of the top face of the core. In the preferred embodiment, four respective radial tracks are plated on the distal face of the core, these being connected together in pairs. Advantageously, the conductive layers of the laminate board which interconnect the transmission line conductors to the radial tracks, whether via plated edges of the board or by means of vias through the board, define connections with the radial tracks which, together, subtend an angle of at least 45° at the core axis. Typically, the subtended angle is in the region of 90°. To achieve a smooth transition of current flow, the conductive layers are preferably fan-shaped (sector-shaped in the most preferred embodiment).

It will be understood that, in a preferred method of assembling the antenna, the feed structure is presented as a unit to the core and inserted into the passage in the core, the insertion causing connection members on the board that extend laterally of the axis of the coaxial line to engage conductive portions on the core, whereafter the laterally extending connection members are conductively bonded to the or each engaged conductive portion on the core. Preferably, the conductive bonding is performed as a single soldering operation. The method includes the further step of conductively bonding the shield conductor to a grounding conductor such as a plate layer forming part of the balun sleeve at the proximal face of the core, preferably as part of the single soldering operation. In the alternative, the coaxial line is first inserted into the core to a predetermined position and, next, the printed circuit board is placed over the distal end of the core and the distal end of the coaxial line. Then, conductive bonding between the coaxial line and the core and/or the coaxial line and the board, as well as between the board and the core, may be performed in a single operation.

The feed structure may include means for spacing an outer wall of the shield conductor from the wall of the passage.

The inner conductor and the shield conductor may be insulated from each other by an air gap over the major part of their length.

According to a further aspect of the invention, there is provided a unitary feed structure for sliding installation in a passage in the insulative core of a dielectrically loaded antenna, wherein the feed structure comprises the unitary combination of: a tubular outer shield conductor; an elongate inner conductor extending through the shield conductor and insulated from the shield conductor; and a laminate board extending laterally outwardly from a distal end of the shield conductor, the laminate board comprising: a proximal surface having first and second proximally directed conductive portions for connection to respective first and second conductors on the antenna core adjacent an end of the passage, the first proximally directed conductive portion and the outer shield conductor being electrically connected; a non-proximal surface or layer having a first non-proximal conductive portion adjacent the inner conductor and being electrically connected thereto; and a linking conductor which electrically connects the first non-proximal conductive portion and the second proximally directed conductive portion.

According to yet another aspect of the invention, a unitary feed structure for sliding installation in a passage in the insulative core of a dielectrically-loaded antenna comprises the unitary combination of a length of transmission line for insertion into the passage of the core; and a laminate board extending outwardly from a distal end of the transmission line, the laminate board comprising: a proximal surface having a proximally directed conductive portion for connection to a conductor on the antenna core adjacent an end of the passage, the proximally directed conductive surface being electrically coupled to a conductor of the transmission line.

The invention also includes a feed structure for a dielectrically-loaded antenna comprising the combination of: a length of transmission line, a laminate board extended outwardly from a distal end of the transmission line, the laminate board comprising a proximal surface having a proximally directed conductive surface portion for connection to a conductor on a dielectric core of the antenna adjacent the end of a passage for receiving the transmission line, the proximally directed conductive surface portion being electrically coupled to a conductor of the transmission line. The laminate board preferably comprises a non-proximally directed conductive portion in electrical connection with the proximally directed conductive portion, the proximally and non-proximally directed conductive portions being connected by a linking conductor adjacent an edge of the board. The linking conductor may form at least part of the proximally directed conductive portion. Additionally, the linking conductor may overlap an edge of the laminate board.

Typically, the laminate board extends outwardly in at least two directions from the transmission line and has a second proximally directed conductive portion for connection to a second conductor on the antenna core adjacent an end of the passage, the proximally directed conductive surface portion being in electrical communication with a second conductor of the transmission line.

The laminate board has a reactive element for matching the transmission line to the radiating structure of the antenna, the reactive element preferably being a capacitor formed between two conductive layers of the board having a dielectric layer between them. The reactive element may also be an inductor formed on one layer of the board.

The laminate board may include a linking conductor extending between distal and proximal surfaces of the laminate board, and may overlap an edge of the board. Preferably, the linking conductor has a width greater than the diameter of the inner conductor of the transmission line where it connects to the laminate board and the associated conductive portion fans outwardly away from the inner conductor to the linking conductor.

BRIEF DESCRIPTION OF THE DRAWINGS

The invention will be described below by way of example with reference to the drawings. In the drawings.

DETAILED DESCRIPTION OF THE PREFERRED EMBODIMENTS OF THE INVENTION

Figure 1:
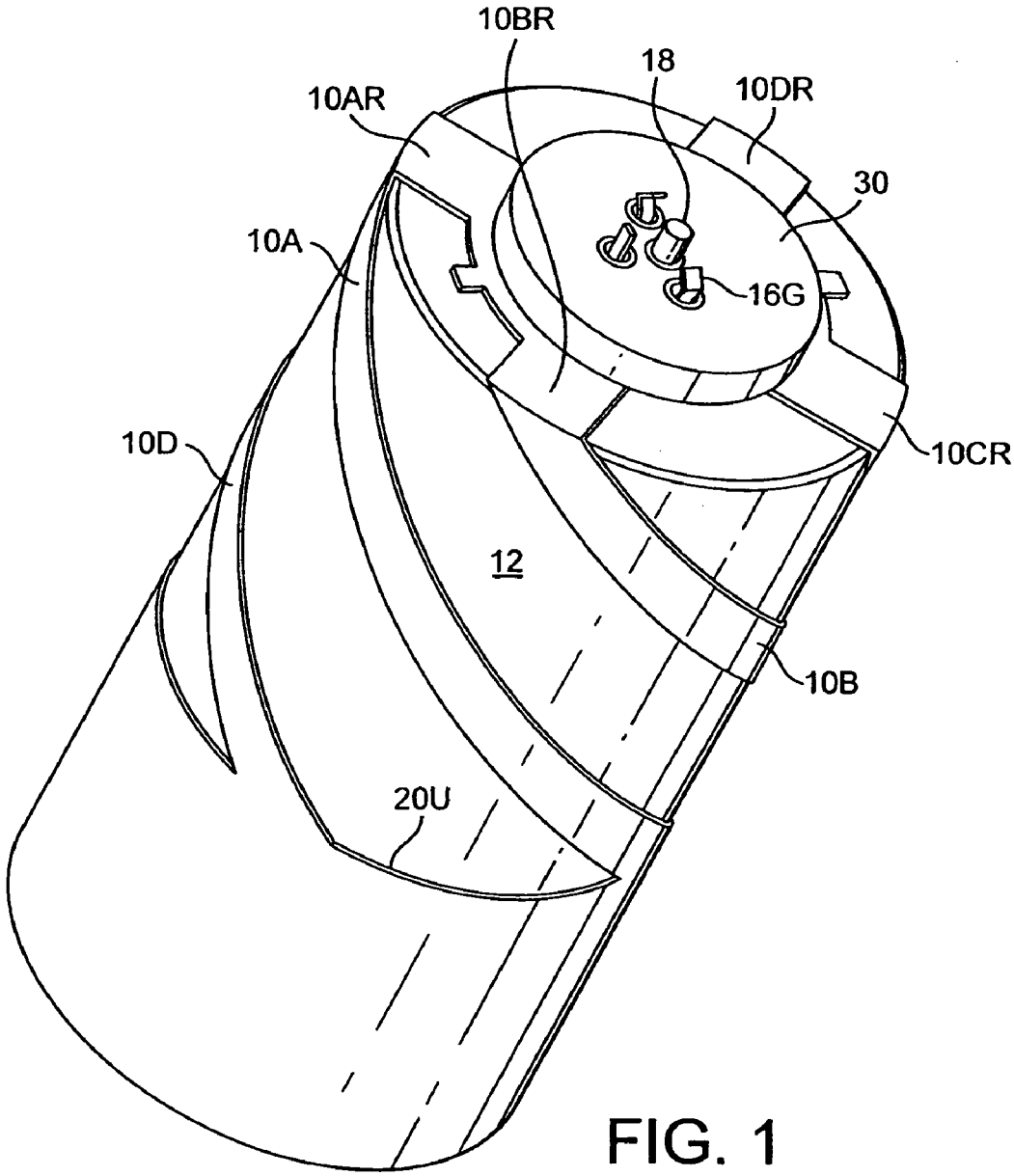
FIG. 1 is a perspective view of a first quadrifilar helical antenna in accordance with the invention, viewed from the above and the side.
Figure 2:
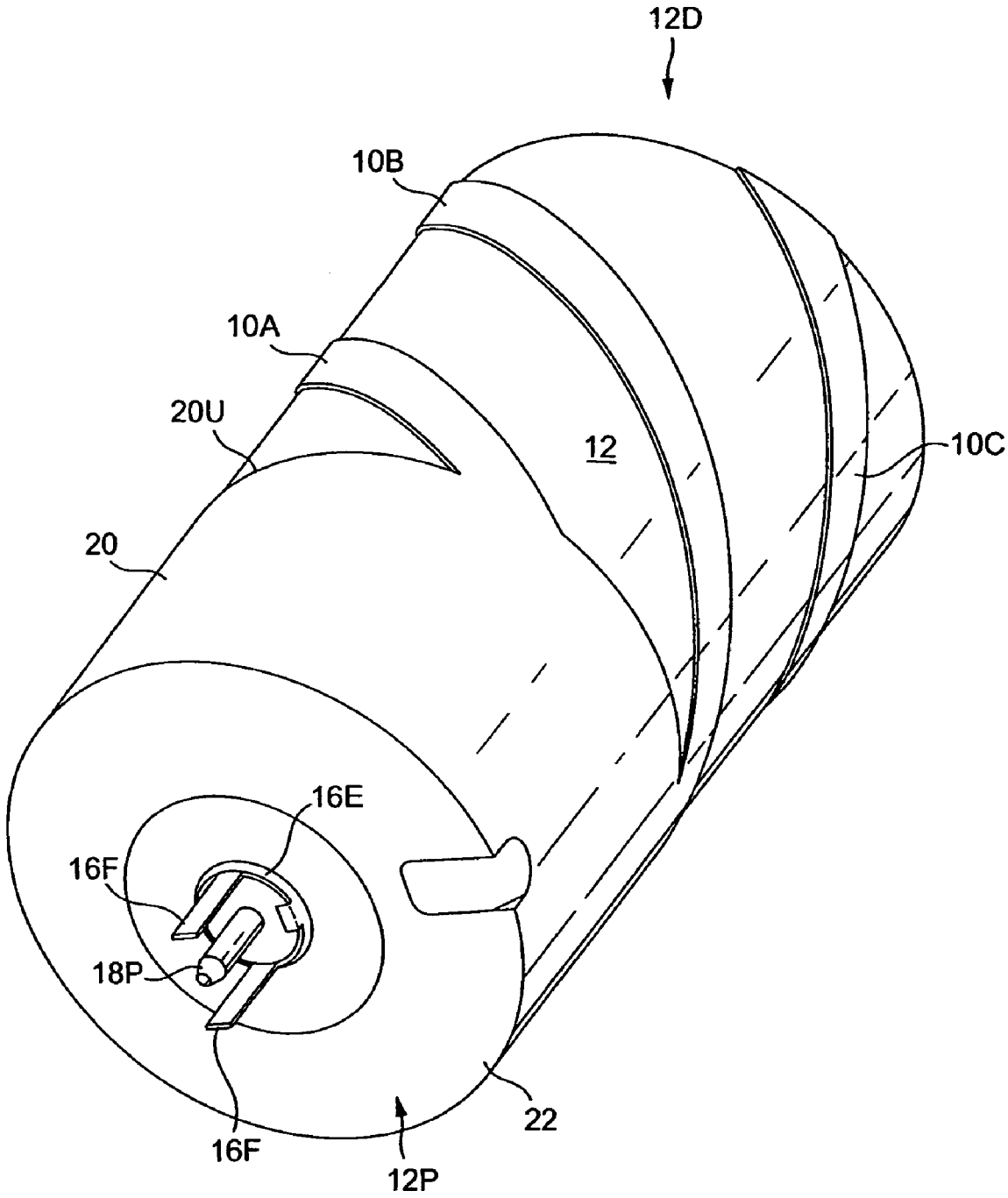
FIG. 2 is a perspective view of the first antenna from below and the side.
Figure 3:
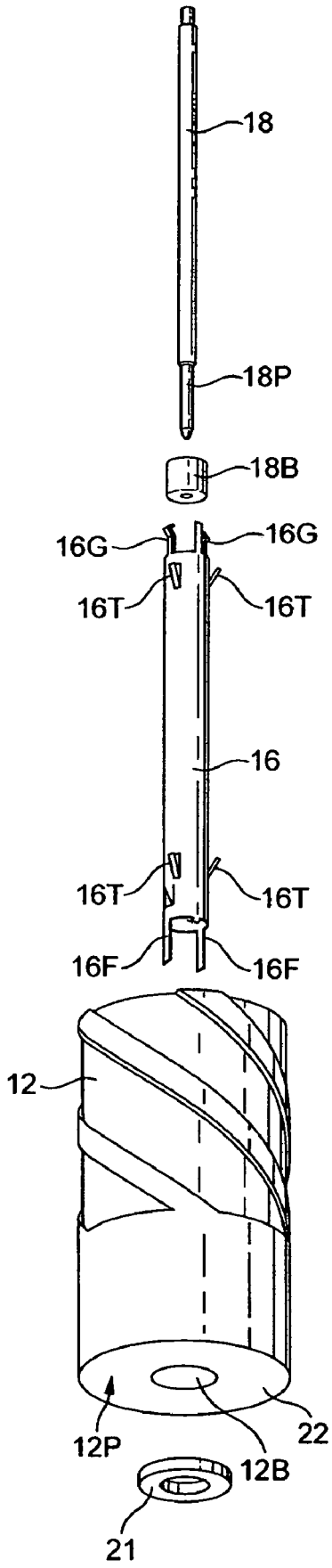
FIG. 3 is a exploded perspective view of a plated antenna core and a coaxial feeder of the antenna of FIGS. 1 and 2.

A first antenna in accordance with the invention has an antenna element structure with four axially coextensive helical tracks 10A, 10B, 10C, 10D plated or otherwise metallised on the cylindrical outer surface of a cylindrical ceramic core 12.

The core has an axial passage in the form of a bore 12B extending through the core 12 from a distal end face 12D to a proximal end face 12P. Both of these faces are planar faces perpendicular to the central axis of the core. They are oppositely directed, in that one is directed distally and the other proximally in this embodiment. Housed within the bore 12B is a coaxial transmission line having a conductive tubular outer shield 16, a first tubular air gap or insulating layer 17, and an elongate inner conductor 18 which is insulated from the shield by the air gap 17. The shield 16 has outwardly projecting and integrally formed spring tangs 16T or spacers which space the shield from the walls of the bore 12B. A second tubular air gap exists between the shield 16 and the wall of the bore.

At the lower, proximal end of the feeder, the inner conductor 18 is centrally located within the shield 16 by an insulative bush 18B.

The combination of the shield 16, inner conductor 18 and insulative layer 17 constitutes a feeder of predetermined characteristic impedance, here 50 ohms, passing through the antenna core 12 for coupling distal ends of the antenna elements 10A to 10D to radio frequency (RF) circuitry of equipment to which the antenna is to be connected. The couplings between the antenna elements 10A to 10D and the feeder are made via conductive connection portions associated with the helical tracks 10A to 10D, these connection portions being formed as radial tracks 10AR, 10BR, 10CR, 10DR plated on the distal end face 12D of the core 12. Each connection portion extends from a distal end of the respective helical track to a location adjacent the end of the bore 12B. The inner conductor 18 has a proximal portion 18P which projects as a pin from the proximal face 12P of the core 12 for connection to the equipment circuitry. Similarly, integral lugs 16F on the proximal end of the shield 16 project beyond the core proximal face 12P for making a connection with the equipment circuitry ground.

The proximal ends of the antenna elements 10A to 10D are connected to a common virtual ground conductor 20 in the form of a plated sleeve surrounding a proximal end portion of the core 12. This sleeve 20 is, in turn, connected to the shield 16 of the feed structure in a manner to be described below.

The four helical antenna elements 10A to 10D are of different lengths, two of the elements 10B, 10D being longer than the other two 10A, 10C as a result of the rim 20U of the sleeve 20 being of varying distance from the proximal end face 12P of the core. Where antenna elements 10A and 10C are connected to the sleeve 20, the rim 20U is a little further from proximal face 12P than where the antenna elements 10B and 10D are connected to the sleeve 20.

The proximal end face 12P of the core is plated, the conductor 22 so formed being connected at that proximal end face 12P to an exposed portion 16E of the shield conductor 16 as described below. The conductive sleeve 20, the plating 22 and the outer shield 16 of the feed structure together form a quarter wave balun which provides common-mode isolation of the antenna element structure from the equipment to which the antenna is connected when installed. The metallised conductor elements formed by the antenna elements and other metallised layers on the core define an interior volume which is occupied by the core.

The differing lengths of the antenna elements 10A to 10D result in a phase difference between currents in the longer elements 10B, 10D and those in the shorter elements 10A, 10C respectively when the antenna operates in a mode of resonance in which the antenna is sensitive to circularly polarised signals. In this mode, currents flow around the rim 20U between, on the one hand, the elements 10C and 10D connected to the inner feed conductor 18 and on the other hand, the elements 10A, 10B connected to the shield 16, the sleeve 20 and plating 22 acting as a trap preventing the flow of currents from the antenna elements 10A to 10D to the shield 16 at the proximal end face 12P of the core. It will be noted that the helical tracks 10A-10D are interconnected in pairs by part-annular tracks 10AB and 10CD between the inner ends of the respective radial tracks 10AR, 10BR and 10CR, 10DR so that each pair of helical tracks has one long track 10B, 10D and one short track 10A, 10C. Operation of quadrifilar dielectrically loaded antennas having a balun sleeve is described in more detail in British Patent Applications Nos. 2292638A and 2310543A, the entire disclosures of which are incorporated in this application to form part of the subject matter of this application as filed.

The feed structure performs functions other than simply conveying signals to or from the antenna element structure. Firstly, as described above, the shield conductor 16 acts in combination with the sleeve 20 to provide common-mode isolation at the point of connection of the feed structure to the antenna element structure. The length of the shield conductor between (a) its connection with the plating 22 on the proximal end face 12P of the core and (b) its connection to the antenna element connection portions 10AR, 10BR, together with the dimensions of the bore 12B and the dielectric constant of the material filling the space between the shield 16 and the wall of the bore, are such that the electrical length of the shield 16 on its outer surface is, at least approximately, a quarter wavelength at the frequency of the required mode of resonance of the antenna, so that the combination of the conductive sleeve 20, the plating 22 and the shield 16 promotes balanced currents at the connection of the feed structure to the antenna element structure.

There is an air gap surrounding the shield 16 of the feed structure. This air sleeve of lower dielectric constant than the dielectric constant of the core 12 diminishes the effect of the core 12 on the electrical length of the shield 16 and, therefore, on any longitudinal resonance associated with the outside of the shield 16. Since the mode of resonance associated with the required operating frequency is characterised by voltage dipoles extending diametrically, i.e. transversely of the cylindrical core axis, the effect of the low dielectric constant sleeve on the required mode of resonance is relatively small due to the sleeve thickness being, at least in the preferred embodiment, considerably less than that of the core. It is, therefore, possible to cause the linear mode of resonance associated with the shield 16 to be de-coupled from the wanted mode of resonance.

The antenna has a main resonant frequency of 500 MHz or greater, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced with respect to an air-cored quadrifilar antenna.

One preferred material of the antenna core 12 is a zirconium-tin-titanate-based material. This material has the above-mentioned relative dielectric constant of 36 and is noted also for its dimensional and electrical stability with varying temperature. Dielectric loss is negligible. The core may be produced by extrusion or pressing, and sintering.

The antenna is especially suitable for L-band GPS reception at 1575 MHz. In this case, the core 12 has a diameter of about 10 mm and the longitudinally extending antenna elements 10A-10D have an average longitudinal extent (i.e. parallel to the central axis) of about 12 mm. At 1575 MHz, the length of the conductive sleeve 20 is typically in the region of 5 mm. Precise dimensions of the antenna elements 10A to 10D can be determined in the design stage on a trial and error basis by undertaking eigenvalue delay measurements until the required phase difference is obtained. The diameter of the feed structure in the bore 12B is in the region of 2 mm.

Further details of the feed structure will now be described. The feed structure comprises the combination of a coaxial 50 ohm line 16, 17, 18 and a planar laminate board 30 connected to a distal end of the line. The laminate board or printed circuit board (PCB) 30 lies flat against the distal end face of the core 12, in face-to-face contact. The largest dimension of the PCB 30 is smaller than the diameter of the core 12 so that the PCB 30 is fully within the periphery of the distal end face 12D of the core 12.

In this embodiment, the PCB 30 is in the form of a disc centrally located on the distal face 12D of the core. Its diameter is such that it overlies the inner ends of the radial tracks 10AR, 10BR, 10CR and 10DR and their respective part-annular interconnections 10AB, 10CD. The PCB has a substantially central hole 32 which receives the inner conductor 18 of the coaxial feeder structure. Three off-centre holes 34 receive distal lugs 16G of the shield 16. Lugs 16G are bent or "jogged" to assist in locating the PCB 30 with respect to the coaxial feeder structure. All four holes 32 are plated through. In addition, portions 30P of the periphery of the PCB 30 are plated, the plating extending onto the proximal and distal faces of the board.

Figure 6:
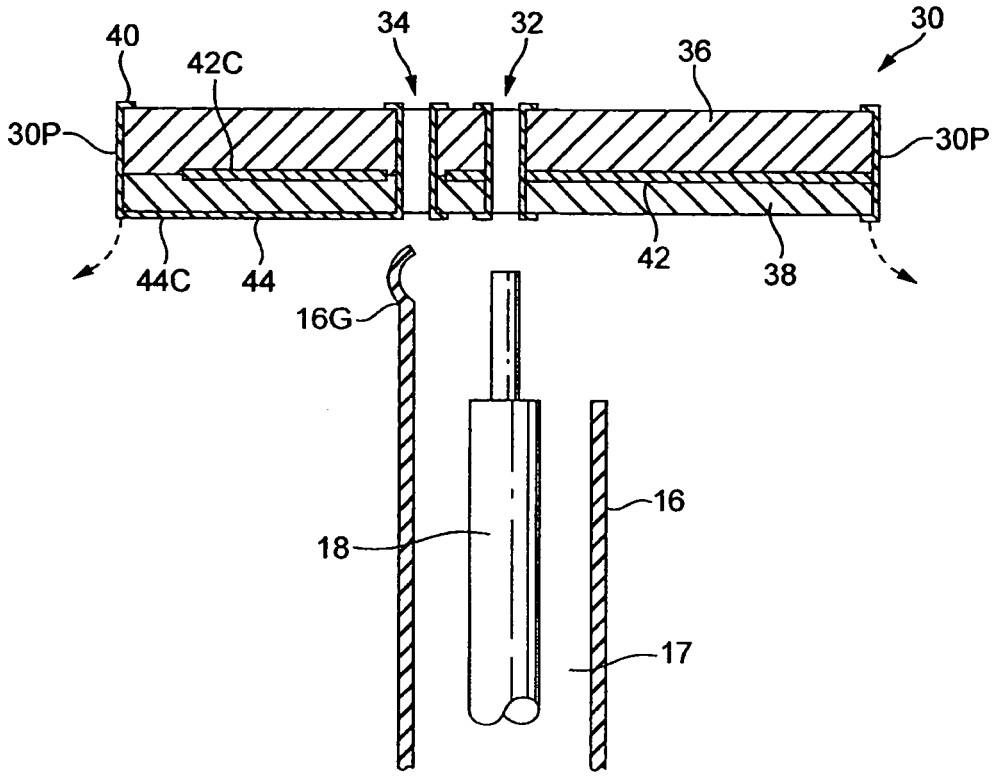
FIG. 6 is a detail of FIG. 5, showing the multiple-layer structure of the laminate board.
Figure 7A:
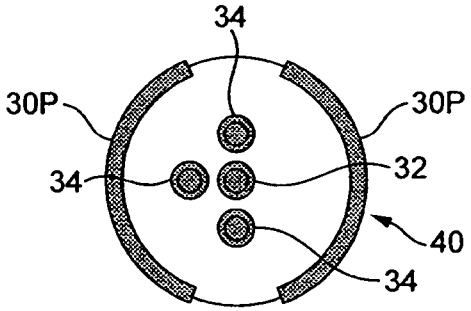
FIGS. 7A to 7C are diagrams showing conductor patterns of the different conductor layers of the laminate board shown in FIGS. 5 and 6.
Figure 7B:
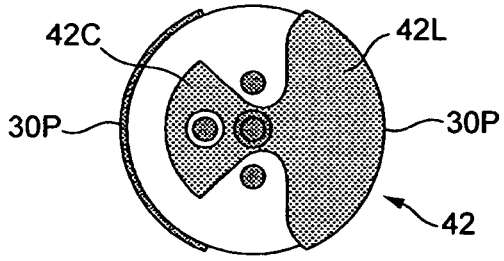
Figure 7C:
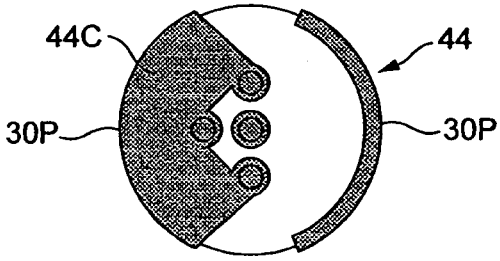

The PCB 30 is a multiple layer laminate board in that it has a plurality of insulative layers and a plurality of conductive layers. In this embodiment, the board has two insulative layers comprising a distal layer 36 and a proximal layer 38. There are three conductor layers as follows: a distal layer 40, an intermediate layer 42, and a proximal layer 44. The intermediate conductor layer 42 is sandwiched between the distal and proximal insulative layers 36, 38, as shown in FIG. 6. Each conductor layer is etched with a respective conductor pattern, as shown in FIGS. 7A to 7C. Where the conductor pattern extends to the peripheral portions 30P of the PCB 30 and to the plated-through holes 32, 34 (hereinafter referred to as "vias"), the respective conductors in the different layers are interconnected by the edge plating and the via plating respectively. As will be seen from the drawings showing the conductor patterns of the conductor layers 40, 42 and 44, the intermediate layer 42 has a first conductor area 42C in the shape of a fan or sector extending radially from a connection to the inner conductor 18 (when seated in via 32) in the direction of the radial antenna element connection portions 10AR, 10BR. Directly beneath this conductive area 42C, the proximal conductor layer 44 has a generally sector-shaped area 44C extending from a connection with the shield 16 of the feeder (when received in plated via 34) to the board periphery 30P overlying the part-annular track 10AB interconnecting the radial connection elements 10AR, 10BR. In this way, a shunt capacitor is formed between the inner feeder conductor 18 and the feeder shield 16, the material of the proximal insulative layer 38 acting as the capacitor dielectric. This material typically has a dielectric constant greater than 5.

The conductor pattern of the intermediate conductive layer 42 is such that it has a second conductor area 42L extending from the connection with the inner feeder conductor 18 to the second plated outer periphery 30P so as to overlie the part-annular track 10CD and the inner ends of the radial connection elements 10CR and 10DR. There is no corresponding underlying conductive area in the conductor layer 44. The conductive area 42L between the central hole 32 and the plated peripheral portion 30P overlying the radial connection tracks 10CR and 10DR acts as a series inductance between the inner conductor 18 of the feeder and one of the pairs of helical antenna elements 10C, 10D.

When the combination of the PCB 30 and the elongate feeder 16-18 is mounted to the core 12 with the proximal face of the PCB 30 in contact with the distal face 12D of the core, aligned over the interconnection elements 10AB and 10CD as described above, connections are made between the peripheral portions 30P and the underlying tracks on the core distal face to form a matching circuit as shown schematically in the drawings.

In this schematic, the feeder is indicated as a coaxial line 50, the antenna elements as a conductive loop 52 and the shunt capacitor and series inductor as capacitor C and inductor L respectively.

The proximal insulative layer of the PCB 30 is formed of a ceramic-loaded plastics material to yield a relative dielectric constant for the layer 38 in the region of 10. The distal insulative layer 36 can be made of the same material or one having a lower dielectric constant, e.g. FR-4 epoxy board. The thickness of the proximal layer 38 is much less than that of the distal layer 36. Indeed, the distal layer 36 may act as a support for the proximal layer 38.

Connections between the feeder 16-18, the PCB 30 and the conductive tracks on the proximal face 12P of the core are made by soldering or by bonding with conductive glue. The feeder 16-18 and the PCB 30 together form a unitary feeder structure when the distal end of the inner conductor 18 is soldered in the via 32 of the PCB 30, and the shield lugs 16G in the respective off-centre vias 34. The feeder 16-18 and the PCB 30 together form a unitary feed structure with an integral matching network.

The shunt capacitance C and the series inductance L form a matching network between the coaxial line 50 (at the distal end of the feeder 16-18) and the radiating antenna element structure of the antenna. The shunt capacitance and the series inductance together match the impedance presented by the coaxial line, physically embodied as shield 16, air gap 17 and inner conductor 18, when connected at its distal end to radiofrequency circuitry having a 50 ohm termination end (i.e. the distal end of the line formed by shield 16, air gap 17 and inner conductor 18), this coaxial line impedance being matched to the impedance of the antenna element structure at its operating frequency or frequencies.

As stated above, the feed structure is assembled as a unit before being inserted in the antenna core 12, the laminate board 30 being fastened to the coaxial line 16-18. Forming the feed structure as a single component, including the board 30 as an integral part, substantially reduces the assembly cost of the antenna, in that introduction of the feed structure can be performed in two movements: (i) sliding the unitary feed structure into the bore 12B and (ii) fitting a conductive ferrule or washer 21 around the exposed proximal end portion of the shield 16. The ferrule may be a push fit on the shield component 16 or is crimped onto the shield. Prior to insertion of the feed structure in the core, solder paste is preferably applied to the connection portions of the antenna element structure on the distal end face 12D of the core 12 and on the plating 22 immediately adjacent the respective ends of the bore 12B. Therefore, after completion of steps (i) and (ii) above, the assembly can be passed through a solder reflow oven or can be subjected to alternative soldering processes such as laser soldering, inductive soldering or hot air soldering as a single soldering step.

The washer 21 referred to above for fitment to the exposed proximal end portion of the shield 16 may take various forms, depending on the structure to which the antenna is to be connected. In particular, the shape and dimensions of the washer will vary to mate with the ground conductors of the equipment to be connected to the antenna, whether such conductors comprise part of a standard coaxial connector kit, a printed circuit board layer, or conductive plane, etc.

The tangs 16T on the feeder shield also help to centralise the feeder and the laminate board 30 with respect to the core 12 during assembly. Solder bridges formed between (a) conductors on the peripheral and the proximal surfaces of the board 30 and (b) the metallised conductors on the distal face 12D of the core, and the shapes of the conductors themselves, are configured to provide balancing rotational meniscus forces during reflow soldering when the board is correctly orientated on the core.

Figure 9:
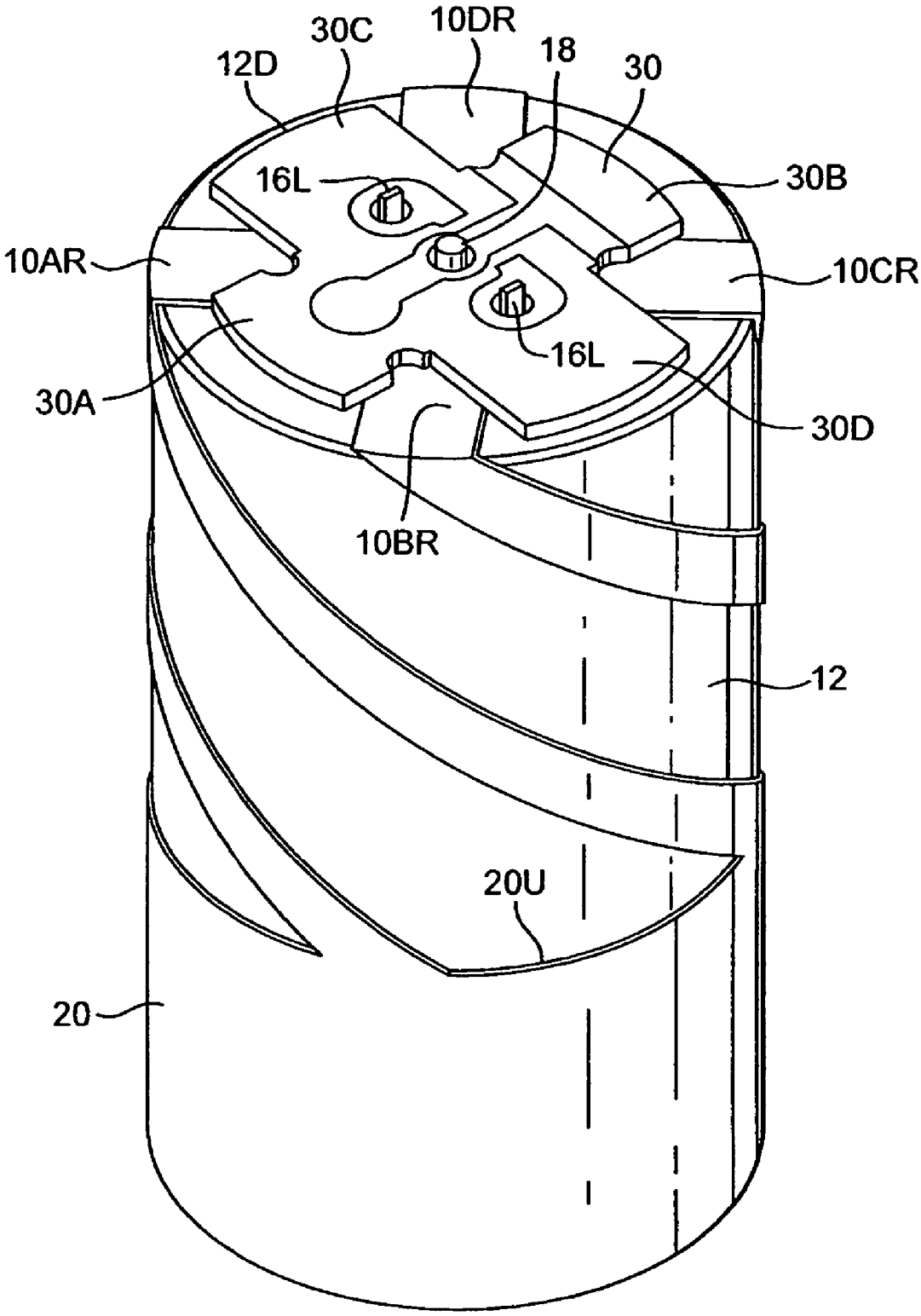
FIG. 9 is a perspective view of a second quadrifilar helical antenna in accordance with the invention.
Figure 10:
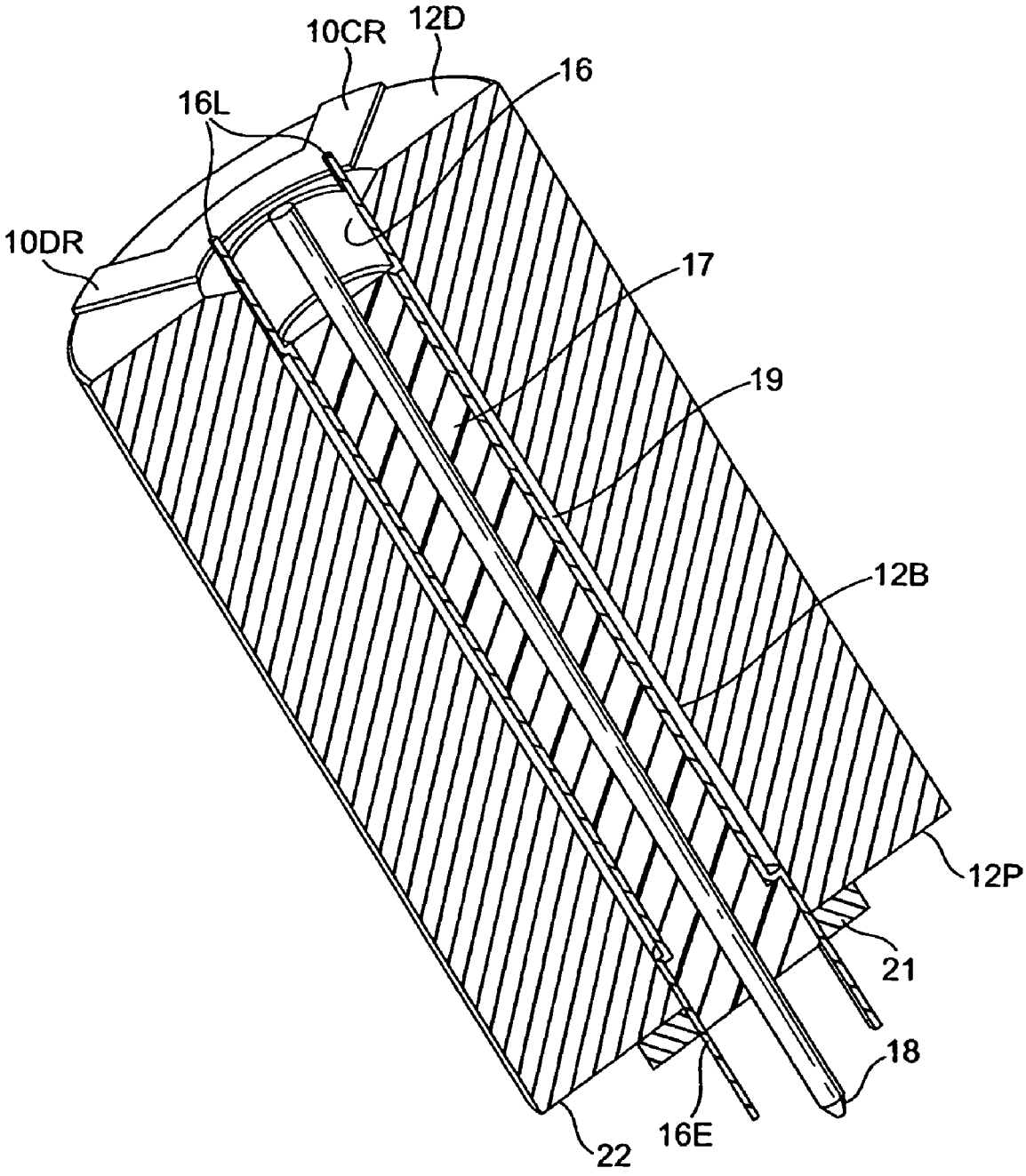
FIG. 10 is an axial cross-section through the antenna of FIG. 9, with a matching section omitted.

Referring now to FIGS. 9 and 10, a second dielectrically loaded antenna in accordance with the invention has an antenna element structure with four axially coextensive helical tracks 10A, 10B, 10C, 10D plated on the cylindrical outer surface of a cylindrical ceramic core 12.

The core has an axial passage in the form of a bore 12B extending through the core 12 from a distal end face 12D to a proximal end face 12P. Both of these faces are planar faces perpendicular to the central axis of the core. Housed within the bore 12B is a coaxial transmission line having a conductive tubular outer shield 16, an insulating layer 17 and an elongate inner conductor 18 insulated from the shield by the insulating layer 17. The shield 16 has two ends which have a larger diameter than the portion of the shield which lies therebetween. An air gap 19 exists between the portion of the shield 16 having a smaller diameter and the wall of the bore.

The combination of the shield 16, inner conductor 18 and insulative layer 17 constitutes a feeder of predetermined characteristic impedance, here 50 ohms, passing through the antenna core 12 for connecting the distal ends of the antenna elements 10A to 10D to radio frequency (RF) circuitry of equipment to which the antenna is to be connected. Connections between the antenna elements 10A to 10D and the feeder are made via conductive connection portions associated with the helical tracks 10A to 10D, these connection portions being formed as radial tracks 10AR, 10BR, 10CR, 10DR plated on the distal end face 12D of the core 12 each extending from a distal end of the respective helical track to a location adjacent the end of the bore 12B.

The other ends of the antenna elements 10A to 10D are connected to a common virtual ground conductor 20 in the form of a plated sleeve surrounding a proximal end portion of the core 12. This sleeve 20 is, in turn, connected to the shield 16 of the feed structure in a manner to be described below.

The four helical antenna elements 10A to 10D are of different lengths, two of the elements 10B, 10D being longer than the other two 10A, 10C as a result of the rim 20U of the sleeve 20 being of varying distance from the proximal end face 12P of the core. Where antenna elements 10A and 10C are connected to the sleeve 20, the rim 20U is a little further from proximal face 12P than where the antenna elements 10B and 10D are connected to the sleeve 20.

The proximal end face 12P of the core is plated, the conductor 22 so formed being connected at that proximal end face 12P to an exposed portion 16E of the shield conductor 16 as described below. The conductive sleeve 20, the plating 22 and the outer shield 16 of the feed structure together form a balun which provides common-mode isolation of the antenna element structure from the equipment to which the antenna is connected when installed.

The differing lengths of the antenna elements 10A to 10D result in a phase difference between currents in the longer elements 10B, 10D and those in the shorter elements 10A, 10C respectively when the antenna operates in a mode of resonance in which the antenna is sensitive to circularly polarised signals. In this mode, currents flow around the rim 20U between, on the one hand, the elements 10C and 10D connected to the inner feed conductor 18 and the elements 10A, 10B connected to the shield 16, the sleeve 20 and plating 22 acting as a trap preventing the flow of currents from the antenna elements 10A to 10D to the shield 16 at the proximal end face 12P of the core.

The feed structure performs functions other than simply conveying signals to or from the antenna element structure. Firstly, as described above, the shield conductor 16 acts in combination with the sleeve 20 to provide common-mode isolation at the point of connection of the feed structure to the antenna element structure. The length of the shield conductor between its connection with the plating 22 on the proximal end face 12P of the core and its connection to the antenna element connection portions 10AR, 10BR, together with the dimensions of the bore 12B and the dielectric constant of the material filling the space between the shield 16 and the wall of the bore are such that the electrical length of the shield 16 is, at least approximately, a quarter wavelength at the frequency of the required mode of resonance of the antenna, so that the combination of the conductive sleeve 20, the plating 22 and the shield 16 promotes balanced currents at the connection of the feed structure to the antenna element structure.

Typically, in this embodiment, the insulating layer 17 is a plastics tube having a relative dielectric constant between 2 and 5. One suitable material, PTFE, has a relative dielectric constant of 2.2.

There is an air gap 19 surrounding the shield 16 of the feed structure. This sleeve of lower dielectric constant than the dielectric constant of the core 12 diminishes the effect of the core 12 on the electrical length of the shield 16 and, therefore, on any longitudinal resonance associated with the outside of the shield 16. Since the mode of resonance associated with the required operating frequency is characterised by voltage dipoles extending diametrically, i.e. transversely of the cylindrical core axis, the effect of the insulative sleeve 19 on the required mode of resonance is relatively small due to the sleeve thickness being, at least in the preferred embodiment, considerably less than that of the core. It is, therefore, possible to cause the linear mode of resonance associated with the shield 16 to be de-coupled from the wanted mode of resonance.

The antenna has a main resonant frequency of 500 MHz or greater, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced with respect to an air-cored quadrifilar antenna.

One preferred material of the antenna core 12 is a zirconium-tin-titanate-based material. This material has the above-mentioned relative dielectric constant of 36 and is noted also for its dimensional and electrical stability with varying temperature. Dielectric loss is negligible. The core may be produced by extrusion or pressing.

As in the case of the first above-described antenna, this antenna is especially suitable for L-band GPS reception at 1575 MHz. The core 12 has a diameter of about 10 mm and the longitudinally extending antenna elements 10A-10D have an average longitudinal extent (i.e. parallel to the central axis) of about 12 mm. At 1575 MHz, the length of the conductive sleeve 20 is typically in the region of 5 mm. Precise dimensions of the antenna elements 10A to 10D can be determined in the design stage on a trial and error basis by undertaking eigenvalue delay measurements until the required phase difference is obtained. The diameter of the feed structure is in the region of 2 mm.

Further details of the feed structure will now be described. Referring to FIGS. 9, 10, 11A and 11B, the feed structure comprises the combination of a coaxial 50 ohm line 16, 17, 18 and a planar laminate board 30 connected to a distal end of the line. The laminate board or printed circuit board (PCB) 30 lies flat against the distal end face of the core 12, in face-to-face contact. The largest dimension of the PCB 30 is smaller than the diameter of the core 12 so that the PCB 30 is fully within the periphery of the distal end face 12D of the core 12.

Figure 11A:
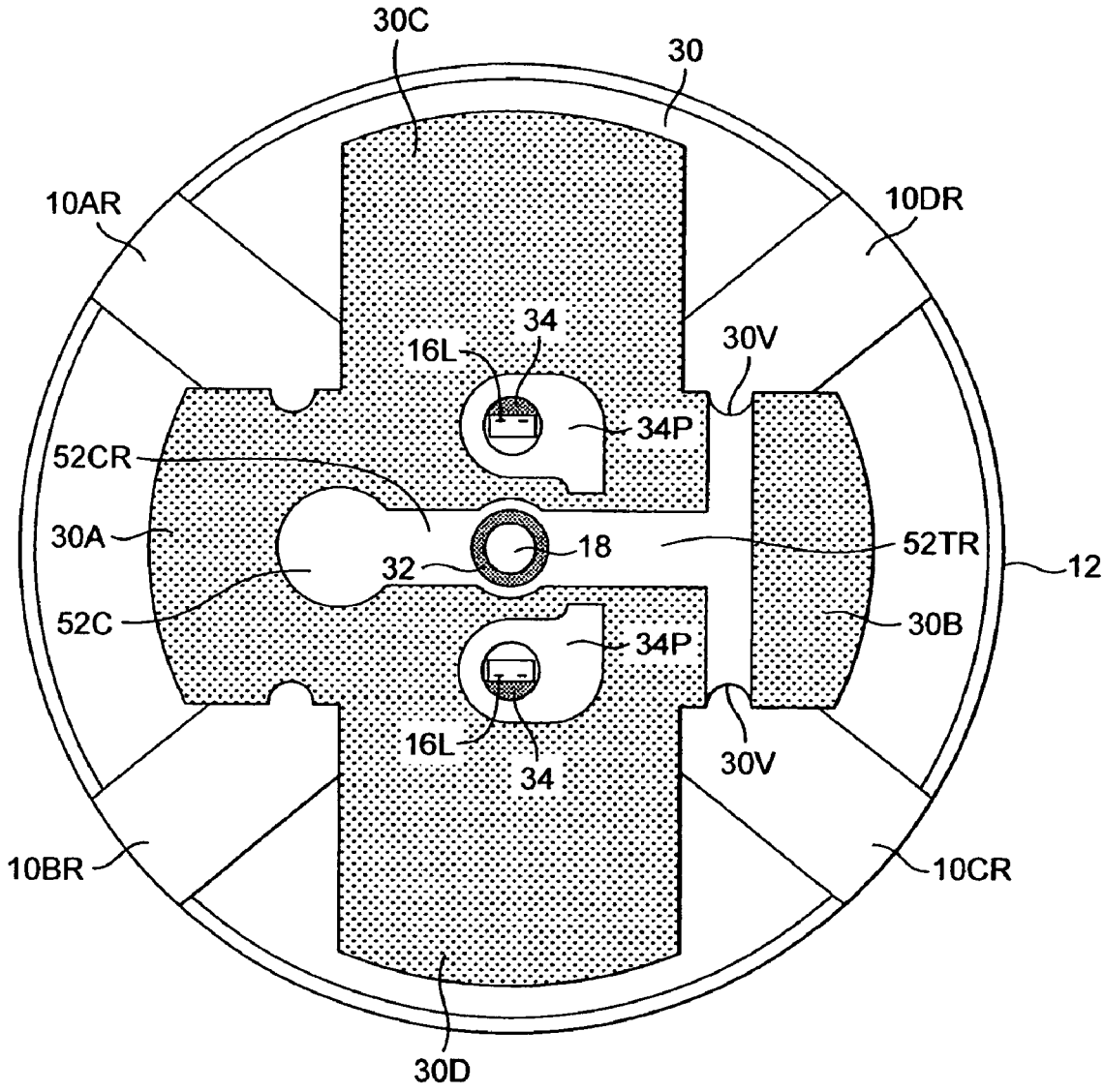
FIGS. 11A and 11B are, respectively, a plan view of a matching section of the second antenna, shown in position on the upper face of the antenna core, and an underside view of the matching section of the second antenna.

The PCB 30 is cross-shaped having two pairs of opposing laterally extending arms 30A, 30B, 30C and 30D. Arms 30A and 30B are shorter than arms 30C and 30D. Referring in particular to FIG. 11A, arm 30A of the PCB 30 lies over the radial tracks 10AR and 10BR of the core 12. Arm 30B of the PCB 30 lies over the radial tracks 10CR and 10DR. The PCB has a central hole 32 which receives the inner conductor 18 of the coaxial feeder structure.

Figure 11B:
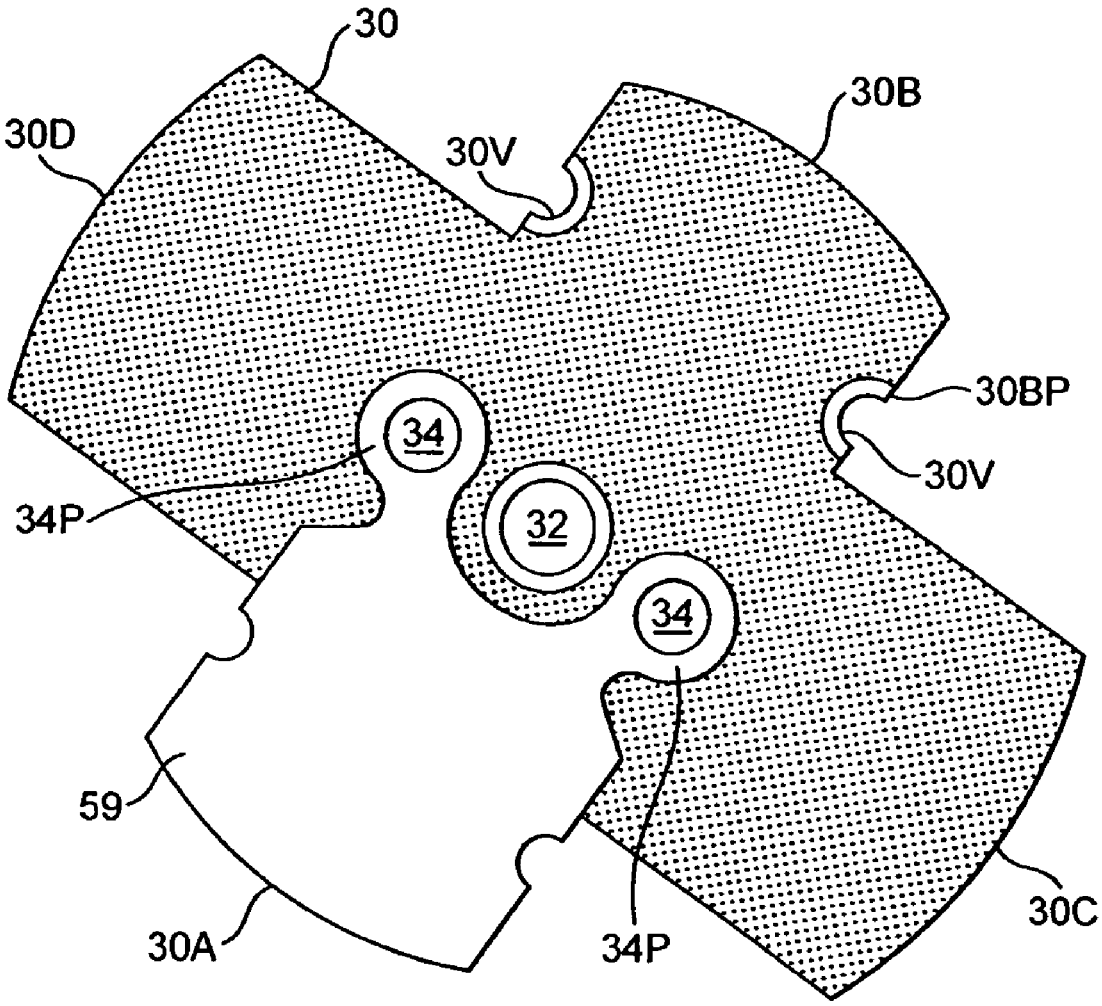

A copper track 52TR forming an inductance extends from the hole 32 into the arm 30B. The track 32TR is soldered to the inner component 18 of the coaxial feed structure. The track 52TR divides to form two perpendicular tracks which extend to the edges of the arm 30B, where they connect to plated vias 30V which extend downwardly to the underside of the PCB 30. Referring to FIG. 11B, the vias 30V connect to copper pads 30BP on the underside of the PCB 30. The pads 30BP lie adjacent the radial tracks 30CR and 30DR and are soldered thereto. A second track 52CR further extends into the arm 30A where it forms a circular pad 52C.

The PCB 30 has two additional holes 34 each located on either side of the central hole 32 in the direction of arms 30C and 30D respectively. The holes are arranged to receive two lugs 16L form part of the shield 16 of the coaxial line and extend from the shield body. The holes 34 are surrounded by annular copper pads 34P on the upper and lower faces of the PCB 30. The lugs 16L are soldered onto the pads 34P. The pads 34P on the lower face of the PCB 30 are connected to a copper ground plane 59 covering the underside of the arm 30A of the PCB 30. The copper ground plane 59 is soldered to the radial tracks 10AR and 10BR.

The circular pad 52C and the copper ground plane 59 at the PCB form a shunt pad capacitor. The track 52TR between the inner conductor 18 and the radial tracks 10AR and 10BR behaves as a series inductance. The shunt capacitance and series inductance form a matching network between the coaxial line 16 to 18 and the radiating antenna element structure of the antenna. The shunt capacitance and series inductance together match the impedance presented by the coaxial line 16, 17, 18 at its distal end (when connected to radio frequency circuitry having a 50 ohm termination at its connection to the antenna) to the impedance of the antenna element structure at its operating frequency or frequencies.

Figure 12A:
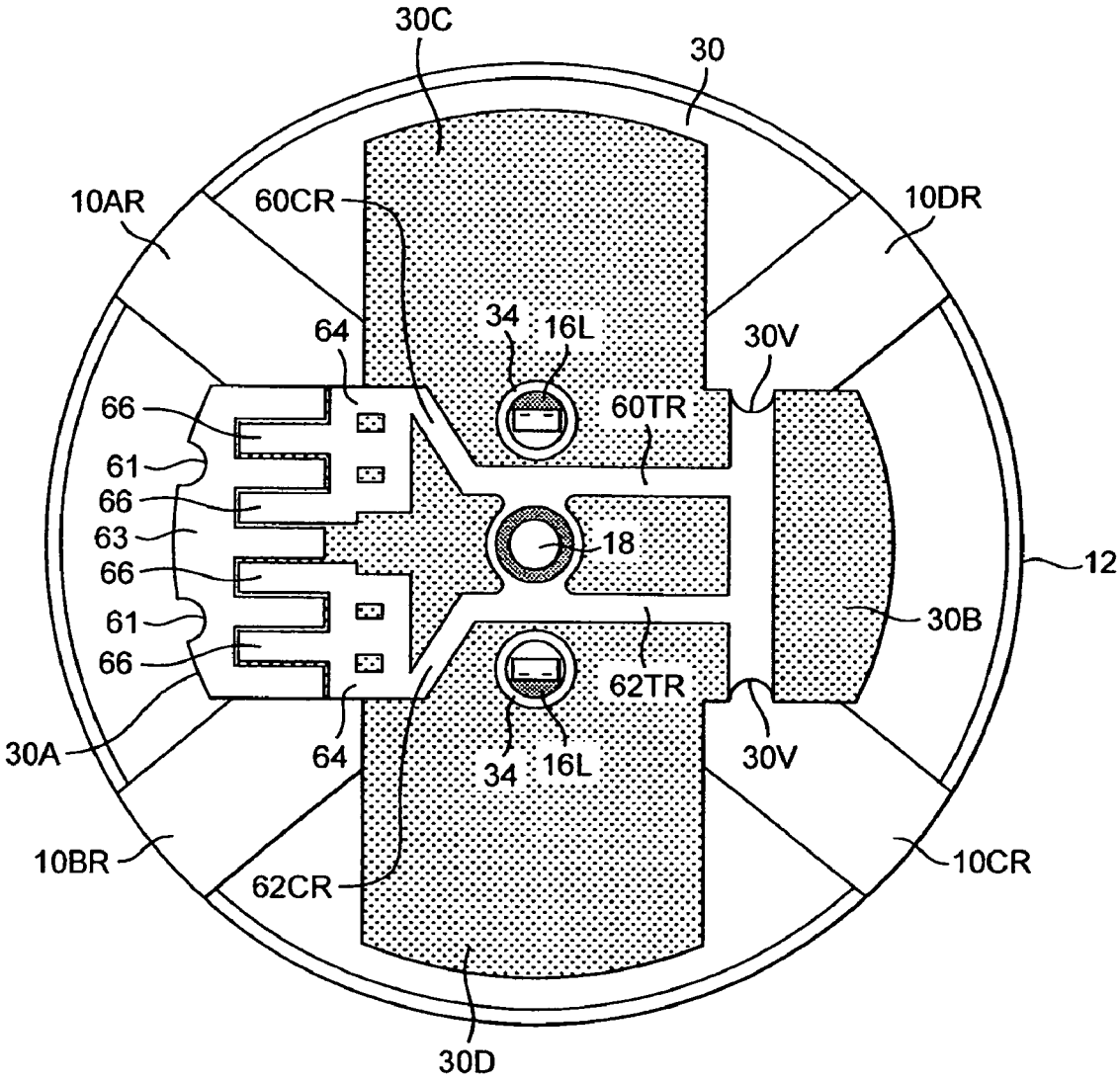
FIGS. 12A and 12B are similar to FIGS. 11A and 11B being, respectively, top and underside plan views of an alternative matching section, including an interdigitated capacitor.
Figure 12B:
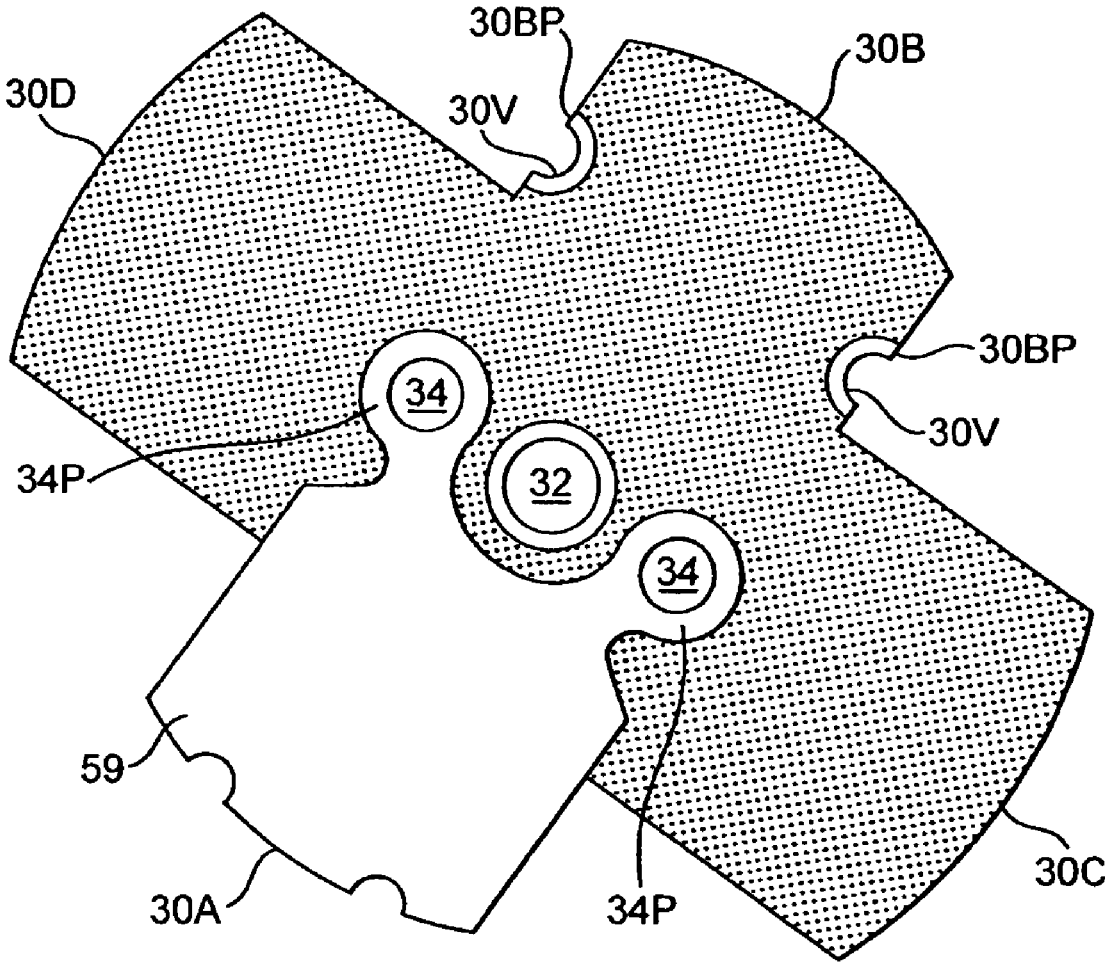

Referring now to FIGS. 12A and 12B, in a variation of the second antenna, the shunt capacitance of the matching network is in the form of an interdigitated capacitor as interdigitated metallised tracks on the top surface of the PCB 30. Two vias 61 extend from the copper ground plane 59 on the underside of the PCB 30 to the top surface of the PCB 30. The vias connect with a copper coating 63 defining 5 fingers or digits extending lengthwise of the arm 30A. The track interconnecting the inner conductor 18 and the antenna elements 10C, 10D is split into two parallel narrow tracks 60TR and 62TR which extend from a connection to the central conductor 18 to connections with the radial tracks 10CR and 10DR on the core. Oppositely directed tracks 60CR, 62CR connect the inner conductor 18 to two separate interdigitated capacitors formed by extensions 66 of the tracks 60CR, 62CR and an interdigitated copper coating 63. Each respective track 60TR and 62TR has laser etched conductive tuning areas 64 and has two digits 66 for capacitive interaction with the digitated coating 63. The tuning areas 64 form adjustable capacitors by capacitive interaction with a ground conductor on the underside of the board.

The feeder structure is assembled as a unit before being inserted in the antenna core 12, the laminate board 30 being fastened to the coaxial line 16-18. Forming the feed structure as a single component including the board 30 as an integral part substantially reduces the assembly cost of the antenna, in that introduction of the feed structure can be performed in two movements: (i) sliding the unitary feed structure into the bore 12B and (ii) fitting a conductive ferrule or washer 21 around the exposed proximal end portion of the shield 16. The ferrule may be a push fit on the shield component 16 or is crimped onto the shield. Prior to insertion of the feed structure in the core, solder paste is preferably applied to the connection portions of the antenna element structure on the distal end face 12D of the core 12 and on the plating 22 immediately adjacent the respective ends of the bore 12B. Therefore, after completion of steps (i) and (ii) above, the assembly can be passed through a solder reflow oven or can be subjected to alternative soldering processes such as laser soldering or hot air soldering as a single soldering step.

The washer 21 referred to above for fitment to the exposed proximal end portion of the shield 16 may take various forms, depending on the structure to which the antenna is to be connected. In particular, the shape and dimensions of the washer will vary to mate with the ground conductors of the equipment to be connected to the antenna, whether such conductors comprise part of a standard coaxial connector kit, a printed circuit board layer, or conductive plane, etc.

Solder bridges formed between conductors at the edges of the board 30 and the metallised conductors on the distal face 12D of the core are configured to provide balancing meniscus forces during reflow soldering when the board is correctly orientated on the core, as described hereinabove.

Figure 4:
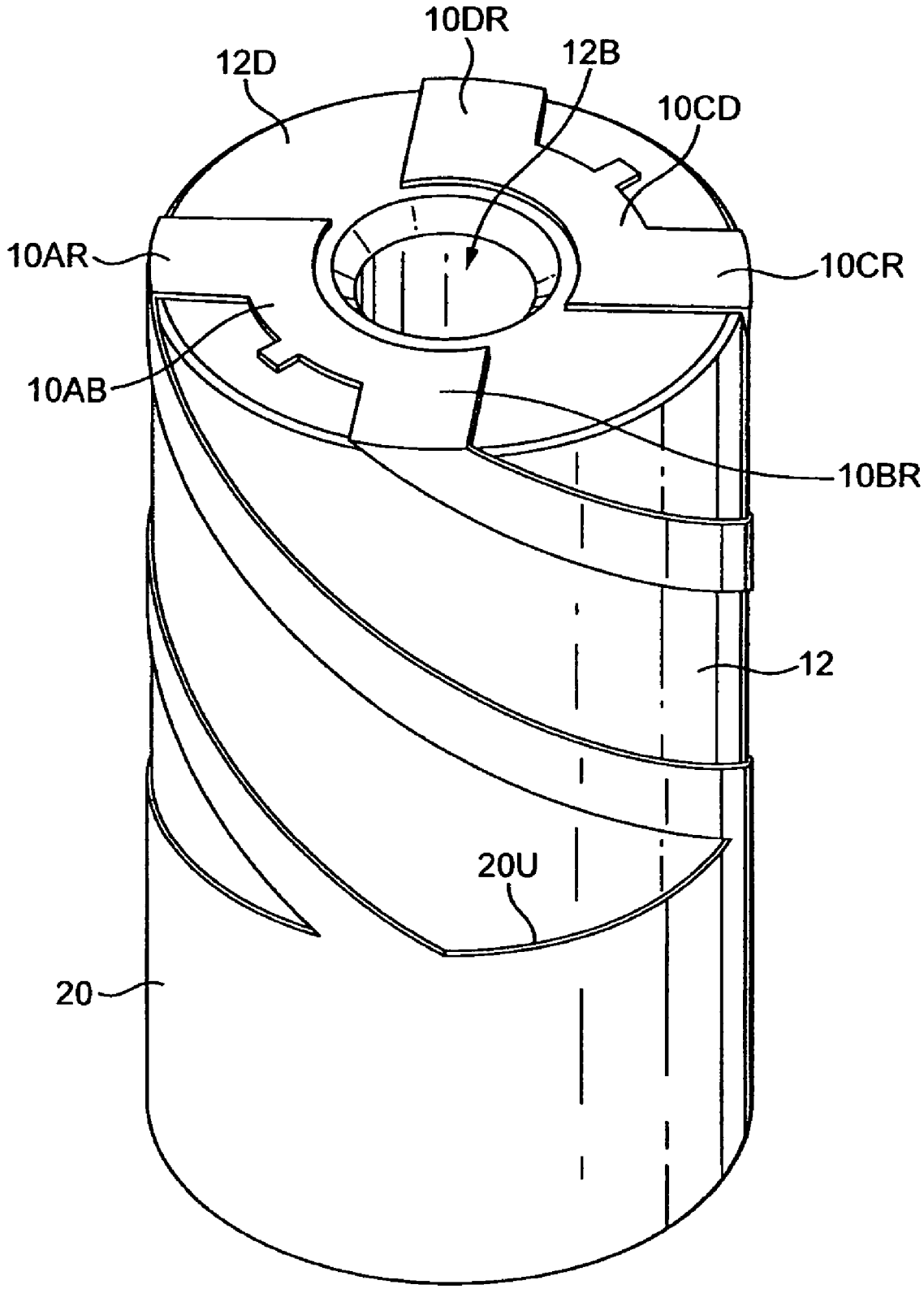
FIG. 4 is a perspective view of the plated antenna core, showing conductors on an upper (distal) surface.
Figure 5:
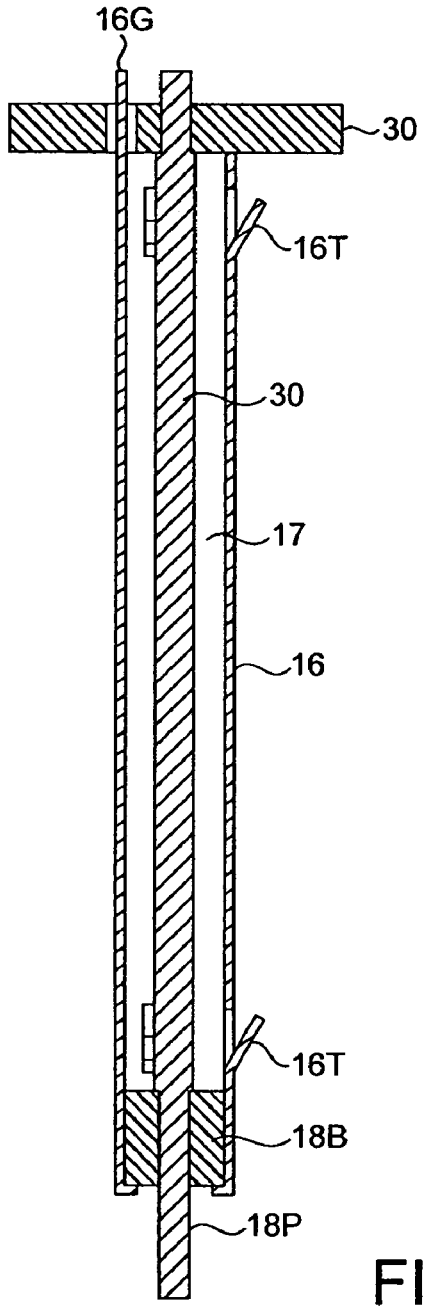
FIG. 5 is a cross-section of a feeder structure comprising a coaxial feeder and a laminate board perpendicular to the axis of the feeder and embodying a matching network.
Figure 8:
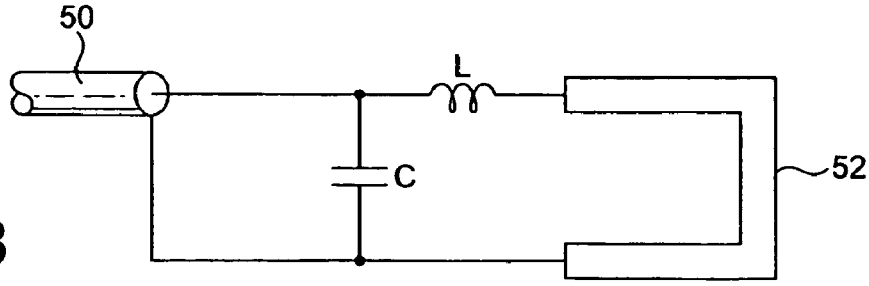
FIG. 8 is an equivalent circuit diagram.

In an alternative embodiment (not shown), the shield 16 of the coaxial line has no connecting lugs but, instead, has a flared or swaged distal end which abuts a conductor layer portion on the underside of the board 30. The conductive layer has a solder coating which provide a solder connection with the swaged end when heated. The swaged end is seated on the chamfered periphery (see FIG. 4) of the distal end of the bore 12B, thereby axially locating the coaxial line 16 to 18 in the core 12.

Figure 13A:
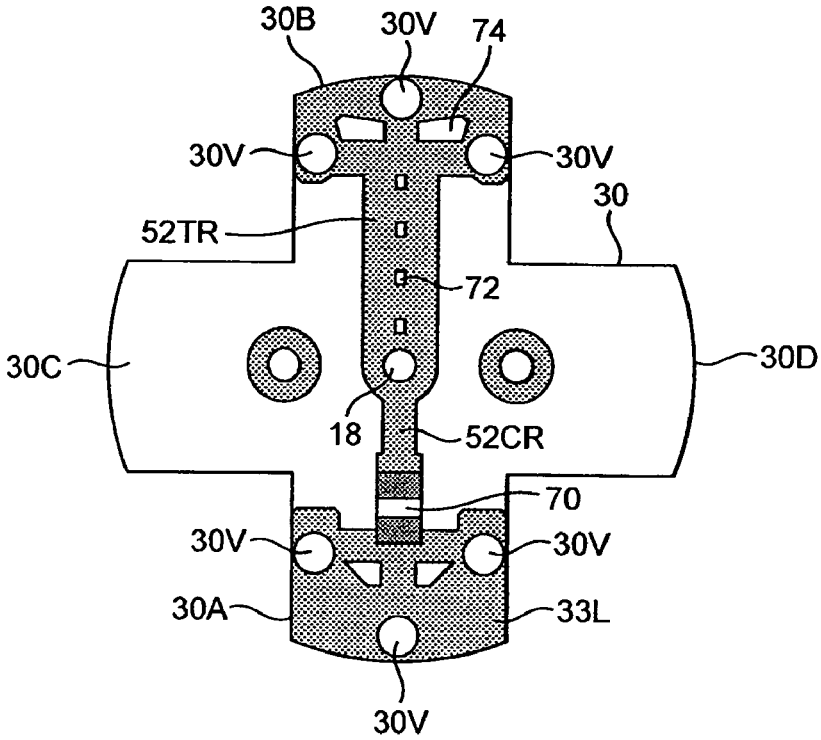
FIGS. 13A and 13B are top and underside plan views of a further alternative matching section for the second antenna, having a lumped capacitor component attached to a laminate board surface.
Figure 13B:
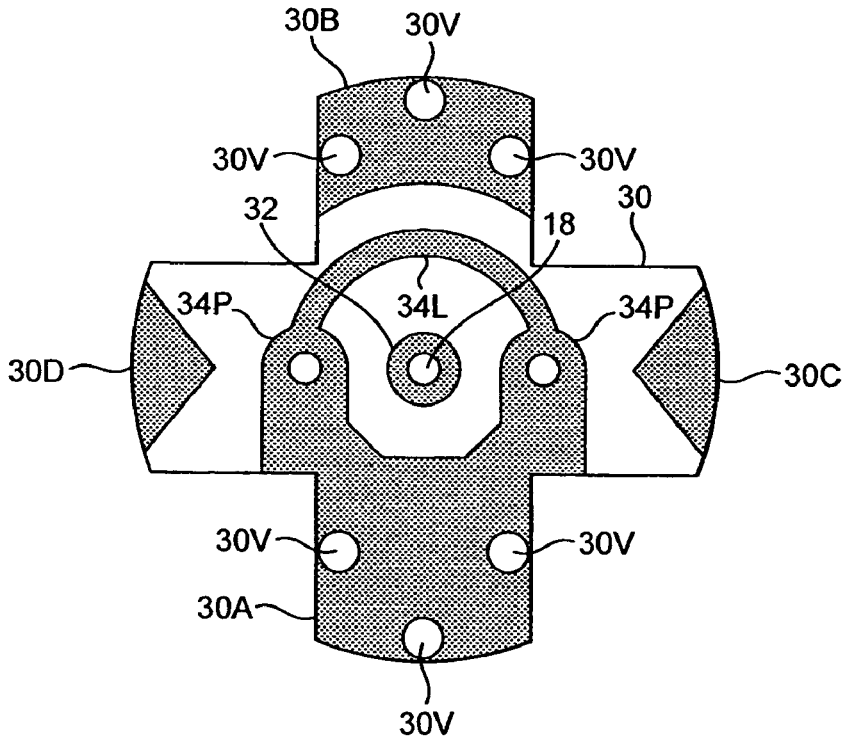

Another embodiment of the invention is shown in FIGS. 13A and 13B. The PCB 30 is the same overall shape as the PCB 30 of the first embodiment, but the copper artwork is modified and the shunt capacitance is provided by the discrete chip capacitor 70, rather than by a printed circuit pad capacitor or interdigitated capacitor. Furthermore, the track 52TR extending from the through hole 32 to the radial tracks 10CR and 10DR on the antenna core 12 to form an inductor is wider and defines four apertures 72 along its radially extending part. The perpendicularly extending parts of the track 52TR extend outwardly to meet the outer three sides of the arm 30B. There are two apertures 74 in this part of the track 52TR. The apertures 72, 74 can be laser etched or otherwise enlarged to align the matching network. Three plated vias 30V connect the track 52TR to the radial tracks 10CR and 10DR on the distal end face 12D of the core 2.

The track 52CR terminates in a discrete capacitor 70 which is in turn connected to a copper layer 33L on the arm 30A. The copper layer 33L is connected to the underside of the arm 30A here by vias 30V.

The underside of the arm 30A is coated by a copper layer which is connected to the pads 34P forming a ground connection to the shield 16. A conductive loop 34L connects the two pads 34P on the opposite side of the central hole 32 from the conductive area on the underside of the arm 30A.

The underside of arm 30B is also coated with a copper layer to form a pad which is soldered to the radial tracks 10CR and 10DR. The layer patterns of this embodiment promote distribution of the currents flowing from/to the feed conductor 18. In this way, the antenna performance is less sensitive to variations in the orientation of the PCB 30 on the core 12.

What is claimed is:

1. A three-dimensional, dielectrically loaded antenna with a frequency of operation in excess of 200 MHz, comprising: an insulative dielectric core of a solid material having a relative dielectric constant greater than 5, a plurality of metallised conductor elements disposed about the core such that they define an interior volume that is occupied by the dielectric core, and a feeder structure which passes longitudinally through the dielectric core, wherein the core has transversely extending end surfaces and a side surface extending longitudinally between the end surfaces, the metallised conductor elements defining a three-dimensional antenna element structure including at least a pair of elongate conductive antenna elements disposed on or adjacent the side surface of the core and extending from one of the end surfaces towards the other end surface; the feeder structure including first and second feed conductors coupled respectively to one and the other of said pair of antenna elements; and a matching section including a shunt capacitance coupled across the antenna elements of the pair, the matching section comprising a laminate board connected to the feeder structure at said one end surface of the core.

2. An antenna according to claim 1, wherein the matching section further includes a series inductance coupled between the capacitance and one of the antenna elements of the pair.

3. An antenna according to claim 1, wherein the core is cylindrical and the antenna elements of said pair comprise conductive helical tracks each extending from said one end surface over the cylindrical side surface, and the antenna element structure includes a linking conductor encircling the core and interconnecting ends of said antenna elements which are at locations spaced from said one end surface of the core.

4. An antenna according to claim 3, wherein the feeder structure includes an axial transmission line section which terminates at said matching section.

5. An antenna according to claim 4, wherein the transmission line section has a characteristic impedance which is higher than the source impedance represented by the antenna element structure.

6. An antenna according to claim 5, wherein the transmission line section has a characteristic impedance of 50 ohms.

7. An antenna according to claim 4, wherein the transmission line section is housed in a passage passing through the core from one end surface to the other end surface.

8. An antenna according to claim 1, wherein the laminate board extends transversely and is secured to said one end surface of the core.

9. An antenna according to claim 8, wherein the feeder structure comprises a transmission line feeder secured to and extending perpendicularly to the laminate board.

10. An antenna according to claim 8, wherein the laminate board comprises an insulative layer and first and second conductive layers in juxtaposition on opposite faces of the insulative layer, the capacitance being formed by said juxtaposed layers.

11. An antenna according to claim 10, wherein the insulative layer includes a ceramic material.

12. An antenna according to claim 11, wherein the relative dielectric constant of the insulative layer is greater than 5.

13. A three-dimensional, dielectrically loaded antenna with a frequency of operation in excess of 200 MHz, comprising: an insulative dielectric core of a solid material having a relative dielectric constant greater than 5, a plurality of metallised conductor elements disposed about the core such that they define an interior volume that is occupied by the dielectric core, and a feeder structure which passes longitudinally through the dielectric core, wherein the core has transversely extending end surfaces and a side surface extending longitudinally between the end surfaces, the metallised conductor elements defining a three-dimensional antenna element structure including at least a pair of elongate conductive antenna elements disposed on or adjacent the side surface of the core and extending from one of the end surfaces towards the other end surface; the feeder structure including first and second feed conductors coupled respectively to one and the other of said pair of antenna elements, wherein the antenna further comprises a matching section in the form of a laminate board secured to the said one end surface of the core and including first and second insulative layers and first and second conductive layers in juxtaposition on opposite faces of the first insulative layer to form a capacitance, the connections of the first and second conductive layers being such that the capacitance is a shunt capacitance coupled across the antenna elements of the said pair of elongate conductive elements, and wherein the second insulative lever is thicker that the first insulative layer, and the first conductive layer is sandwiched between the first and second insulative layers.

14. A three dimensional, dielectrically loaded antenna with a frequency of operation in excess of 200 MHz, comprising: a cylindrical insulative dielectric core of a solid material having a relative dielectric constant greater than 5, a plurality of metallised conductor elements disposed about the core such that they define an interior volume that is occupied by the dielectric core, all surfaces of the dielectric core having metallised conductor elements, and a feeder structure which passes through the dielectric core, wherein the core has a distal surface, a proximal surface and a cylindrical side surface, wherein the metallised conductor elements define a three-dimensional antenna element structure including at least one pair of elongate conductive antenna elements disposed on or adjacent the side surface of the core and each extending from the distal surface of the core in the direction of the proximal surface; and wherein the feed structure comprises the combination of a transmission line section having at an end thereof a first conductor coupled to one of said pair of antenna elements and a second conductor coupled to the other of said pair of antenna elements and, associated with said end of the transmission line section, a matching section in the form of a laminate board including at least one reactive matching element.

15. An antenna according to claim 14, wherein the laminate board lies perpendicularly to the axis of the core.

16. An antenna according to claim 14, wherein the laminate board includes at least one reactive matching element formed by at least one conductive layer of the board.

17. An antenna according to claim 16, wherein the reactive element is a shunt reactance connected across the antenna elements of said pair.

18. An antenna according to claim 17, wherein the matching section includes a second reactive element comprising a reactance connected in series between the shunt reactance and one of the antenna elements of said pair or between the shunt reactance and one of the conductors of the transmission line section.

19. An antenna according to claim 14, wherein the laminate board includes at least one lumped reactive matching element.

20. An antenna according to claim 19, wherein the lumped reactive element is a capacitor mounted on conductive pads on the board.

21. An antenna according to claim 14, wherein the transmission line section is a coaxial feed line.

22. An antenna according to claim 21, wherein the feed line is located in a passage in the core and includes an outer shield conductor having spacers projecting from an outer surface thereof to centralise the feed line in the passage with an air gap around the shield.

23. An antenna according to claim 22, wherein the spacers are tangs integrally farmed on the shield.

24. An antenna according to claim 21, wherein the feed line includes an outer shield having at said end of said transmission line section at least one lug which is received in a through-hole in the laminate board, the lug being bent to assist in locating the laminate board with respect to the feed line.

25. An antenna according to claim 24, wherein the lug is integrally formed on the shield.

26. An antenna according to claim 14, wherein the antenna element structure comprises at least two pairs of elongate conductive antenna elements disposed on or adjacent the side surface of the core and extending from the distal surface of the core in the direction of the proximal surface, wherein the first transmission line conductor is coupled to one antenna element of each of said two pairs and the second transmission line conductor is coupled to the other antenna element of each of said two pairs.

27. An antenna according to claim 26, wherein said reactive matching element is coupled as a shunt element between the antenna elements of each of said two pairs.

28. An antenna according to claim 26, wherein the laminate board includes a conductive layer interconnecting the first conductor of the transmission line section with a first antenna element of each of said two pairs, the conductive layer being shaped to allow connection between the board and said first antenna elements at a plurality of locations.

29. An antenna according to claim 28, wherein said connection locations. together subtend an angle of at least 45 degrees at the core axis.

30. An antenna according to claim 28, wherein the board includes a conductive layer which fans out for angularly distributed connection to said first antenna elements.

31. An antenna according to claim 28, including a conductive layer portion shaped to define an angularly distributed connection between the second conductor of the transmission line section and second antenna elements of said two pairs.

32. An antenna according to claim 31, wherein the angularly distributed connection subtends an angle of at least 45 degrees at the core axis.

33. An antenna according to claim 14, wherein connections between the matching section and the antenna elements include plated edge portions of the board.

34. A three-dimensional, dielectrically loaded antenna with a frequency of operation in excess of 200 MHz, comprising an insulative dielectric core of a solid material having a relative dielectric constant greater than 5, a plurality of metallised conductor elements disposed about the core such that they define an interior volume that is occupied by the dielectric core, all surfaces of the dielectric core having metallised conductor elements, and a unitary feeder structure which passes through the dielectric core and comprises the unitary combination of:

a tubular outer shield conductor;

an elongate inner conductor extending through the shield conductor and insulated from the shield conductor; and a laminate board extending laterally outwardly from a distal end of the shield conductor, the laminate board comprising:

a proximal surface having first and second proximally directed conductive portions for connection to respective first and second conductors on the antenna core adjacent an end of the passage, the first proximally directed conductive portion and the outer shield conductor being electrically connected;

a non-proximal surface or layer having a first non-proximal conductive portion adjacent the inner conductor and being electrically connected thereto; and a linking conductor which electrically connects the first non-proximal conductive portion and the second proximally directed conductive portion.

35. A three-dimensional, dielectrically loaded antenna with a frequency of operation in excess of 200 MHz, comprising an insulative dielectric core of a solid material having a relative dielectric constant greater than 5, a plurality of metallised conductor elements disposed about the core such that they define an interior volume that is occupied by the dielectric core, all surfaces of the dielectric core having metallised conductor elements, and a unitary feeder structure which passes through the dielectric core and comprises the unitary combination of:

a length of transmission line for insertion into the passage of the core; and a laminate printed circuit board extending outwardly from a distal end of the transmission line, the laminate board comprising:

a proximal surface having a proximally directed conductive portion for connection to a conductor on the antenna core adjacent an end of the passage, the proximally directed conductive surface being in electrical communication with a conductor of the transmission line.

36. A three dimensional, dielectrically loaded antenna with a frequency of operation in excess of 200 MHz, comprising: a cylindrical insulative dielectric core of a solid material having a relative dielectric constant greater than 5, a plurality of metallised conductor elements disposed about the core such that they define an interior volume that is occupied by the dielectric core, all surfaces of the dielectric core having metallised conductor elements, and a feeder structure which passes through the dielectric core, wherein the core has a distal surface, a proximal surface and a cylindrical side surface, wherein the metallised conductor elements define a three-dimensional antenna element structure including at least one pair of elongate conductive antenna elements disposed on or adjacent the side surface of the core and each extending from the distal surface of the core in the direction of the proximal surface; and wherein the feed structure comprises the combination of a transmission line section passing through the core and a matching circuit having at least one reactive matching element, wherein the matching circuit comprises a laminate board in the form of an insulative substrate and a conductive layer coupled to the transmission line section, the board being oriented perpendicularly to the transmission line section.

37. An antenna according to claim 36, wherein the board is in face-to-face contact with an end surface of the core.

38. An antenna-according to claim 37, wherein the laminate board has a pair of conductive layers on opposite faces of the insulative substrate, the conductive layers being configured to form a matching component, and wherein one of said conductive layers engages a conductive element metallised on said end surface of the core.

39. A three-dimensional dielectrically loaded antenna with a frequency of operation in excess of 200 MHz, comprising an insulative dielectric core of a solid material having a relative dielectric constant greater than 5, a plurality of metallised conductor elements disposed about the core such that they define an interior volume that is occupied by the dielectric core, all surfaces of the dielectric core having metallised conductor elements. and a unitary feeder structure which passes through the dielectric core and comprises the unitary combination of:

a length of transmission line for insertion into the passage of the core; and a laminate board extending around the transmission line and extending outwardly from a distal end of the transmission line, the laminate board comprising:

a proximal surface having a proximally directed conductive portion for connection to a conductor on the antenna core adjacent an end of the passage, the proximally directed conductive surface being in electrical communication with a conductor of the transmission line.

* * * * *

UNITED STATES PATENT AND TRADEMARK OFFICE

CERTIFICATE OF CORRECTION

PATENT NO. : 7,439,934 B2
APPLICATION NO. : 11/472587
DATED : October 21, 2008
INVENTOR(S) : Leisten et al.

It is certified that error appears in the above-identified patent and that said Letters Patent is hereby corrected as shown below:

Col. 17, Ln. 64, in claim 23, change “farmed” to --formed--.

Col. 18, Ln. 25, in claim 29, change “locations.” to --locations--.

Signed and Sealed this

Thirty-first Day of March, 2009

John Doll

JOHN DOLL
*Acting Director of the United States Patent and Trademark Office*